US008967411B2

(12) United States Patent
Ferreira et al.

(10) Patent No.: US 8,967,411 B2
(45) Date of Patent: Mar. 3, 2015

(54) PRESSURE RELIEF DEVICE FOR PRESSURIZED CONTAINER

(75) Inventors: Mark A. Ferreira, Decatur, AL (US); Yurij F. Wowczuk, Pittsburgh, PA (US); Richard A. Henry, Decatur, AL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/636,849

(22) PCT Filed: Jun. 3, 2011

(86) PCT No.: PCT/US2011/039019

§ 371 (c)(1), (2), (4) Date: Sep. 24, 2012

(87) PCT Pub. No.: WO2011/153405

PCT Pub. Date: Dec. 8, 2011

(65) Prior Publication Data

US 2013/0020320 A1 Jan. 24, 2013

Related U.S. Application Data

(60) Provisional application No. 61/351,351, filed on Jun. 4, 2010.

(51) Int. Cl.

| | |
|---|---|
| ***B65D 90/36*** | (2006.01) |
| ***B65D 83/14*** | (2006.01) |
| ***B65D 83/70*** | (2006.01) |
| ***B65D 83/38*** | (2006.01) |

(52) U.S. Cl.

CPC ..... *B65D 83/70* (2013.01); *B65D 83/38* (2013.01); *B65D 2213/00* (2013.01)

USPC ..... 220/89.2; 220/624; 137/68.27

(58) Field of Classification Search

USPC ..... 220/89.2, 624, 203.08; 222/397; 137/910, 68.27, 68.28, 68.26; 413/12; 29/413

See application file for complete search history.

(56) References Cited

U.S. PATENT DOCUMENTS

| | | | | |
|---|---|---|---|---|
| 3,731,838 | A | 5/1973 | Gedde | |
| 3,815,534 | A * | 6/1974 | Kneusel | 413/12 |
| 4,515,284 | A | 5/1985 | Lee, Jr. et al. | |
| 7,222,757 | B2 | 5/2007 | Ferreira et al. | |
| 2006/0043122 | A1 * | 3/2006 | Ferreira et al. | 222/397 |

OTHER PUBLICATIONS

An International Search Report and Written Opinion, dated Nov. 17, 2011, in International Application No. PCT/US2011/039019.

* cited by examiner

*Primary Examiner* — Mickey Yu
*Assistant Examiner* — Allan Stevens

(57) ABSTRACT

A pressure relief device of domed construction for venting an internally pressurized container. The pressure release device includes a coined pressure vent and is characterized by a relatively high venting pressure in combination with a failure pressure in the absence of venting which is higher than the intended venting pressure. The pressure relief device includes a sloped sidewall having an outer annular segment and a sloped annular intermediate segment. The sloped annular intermediate segment has a width dimension greater than the width dimension of the outer annular segment. A circular central plateau defines a flat dome top. The circular central plateau has a center point with an arc shaped coin line extending about an arc with the apex of the arc positioned at the center point of the circular central plateau.

17 Claims, 4 Drawing Sheets

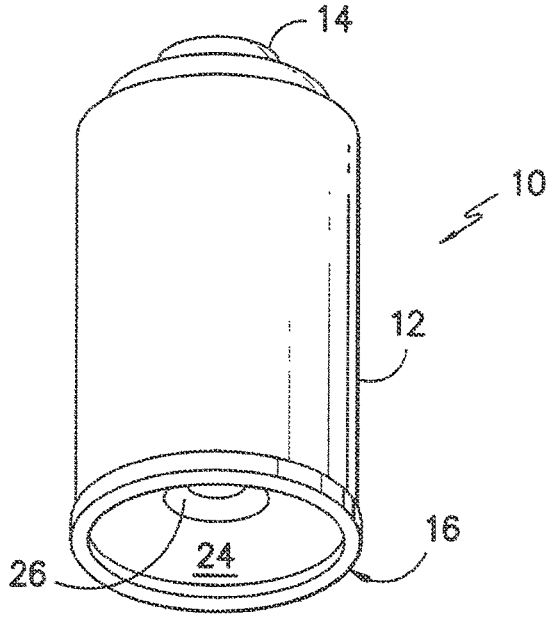
FIG. —1—
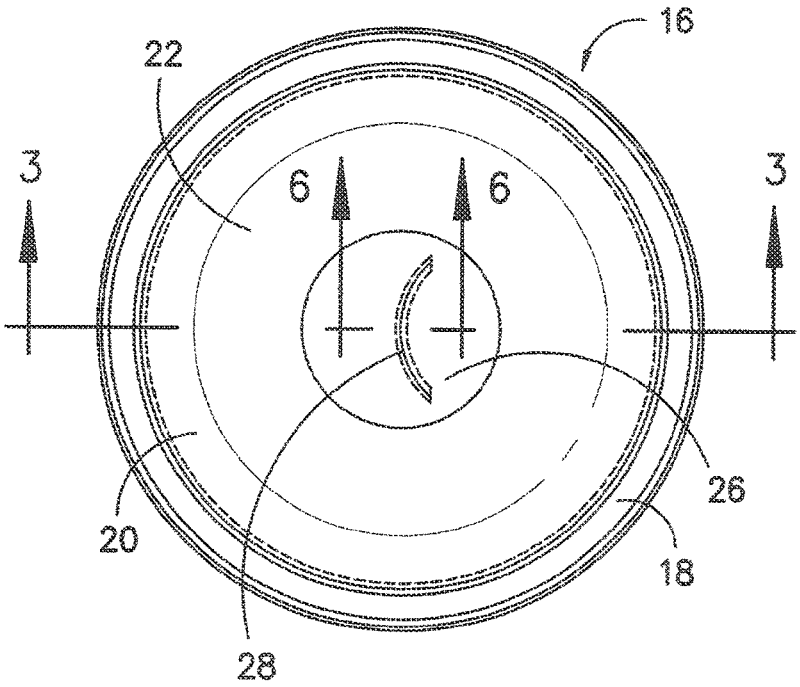
FIG. —2—

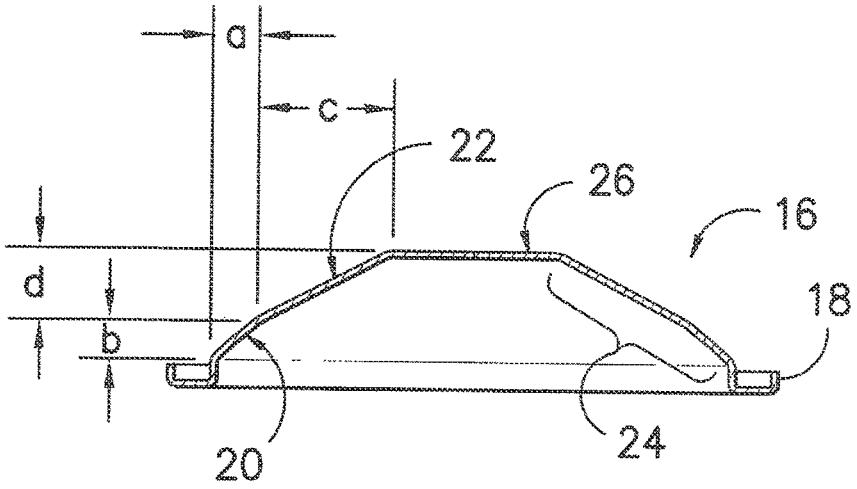
FIG. —3—
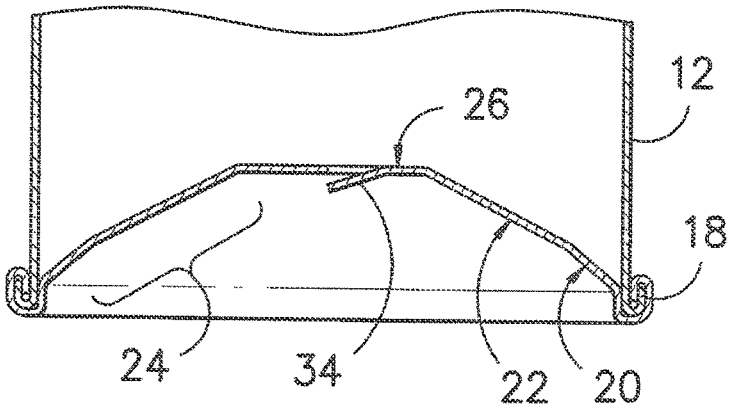
FIG. —4—

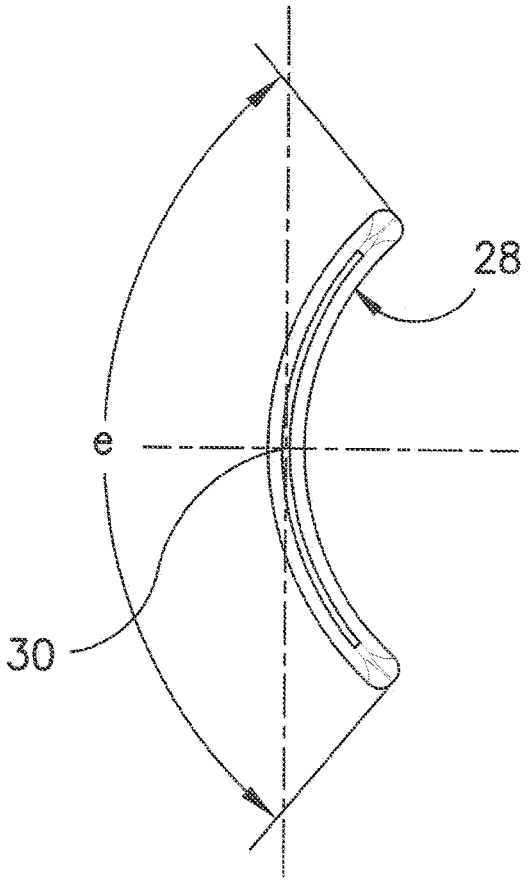
FIG. —5—
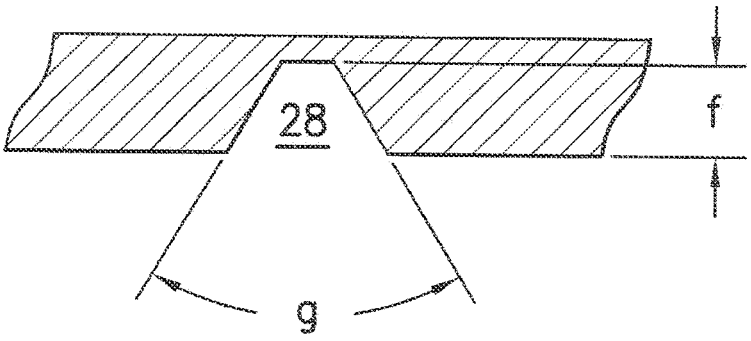
FIG. —6—

PRESSURE RELIEF DEVICE FOR PRESSURIZED CONTAINER

CROSS REFERENCE TO RELATED APPLICATIONS

This non-provisional application claims the benefit of and priority from U.S. provisional application 61/351,351 filed Jun. 4, 2010. The contents of such prior application are hereby incorporated by reference in their entirety as if fully set forth herein.

TECHNICAL FIELD

This invention relates to pressure release devices for internally pressurized fluid containers and aerosol cans having such pressure relief devices.

BACKGROUND OF THE INVENTION

Pressurized fluid containers are in widespread use for packaging and dispensing a variety of fluid products, including liquids, gases, solids and combinations thereof. Under normal operating conditions, such containers perform entirely satisfactorily. However, in the event that the contents of such containers become over-pressurized, either because of improper use, exposure to heat or for any other reason, then a violent rupture may occur. The art has provided a variety of pressure relief devices for aerosol cans to prevent explosion of the pressurized can. Many of these pressure relief devices are in the bottom of the can, while some are in the sidewall or top.

By way of example only, one category of pressure relief devices provides one or more concave regions in the bottom of the can in combination with coined lines of reduced material thickness. In this regard, it is to be understood that the term "coin" or "coining" denotes a process of moving or displacing metal to achieve a desired indentation profile and includes scoring and/or applied pressure techniques as will be well known to those of skill in the art. In operation, the bottom fractures along the coined lines (or curvatures) in response to an over pressurization of the container contents thereby creating vent openings. A controlled and predictable release of pressure is thus provided. One such system which has been found to be highly effective is disclosed in U.S. Pat. No. 7,222,757 to Ferreira et al., the contents of which are incorporated herein by reference in their entirety.

Typically, in the prior venting systems it is desirable to consistently maintain a prescribed coin depth along the fracture lines to provide a defined venting pressure. A coin depth which is too shallow will result in a high pressure release. On the other hand, a deeper coin depth may produce a prematurely low pressure release, and may prompt the development of micro cracks in the remaining relatively thin web at the base of the coined line. Thus, the manufacturing process must be carefully monitored with particular attention to timely equipment (and tooling) adjustments to compensate for tool wear, and, when appropriate, to replace worn coining tools. Carrying out such monitoring requires frequent product sampling and testing. This requires a relatively high level of skill and may significantly increase manufacturing costs. Thus, while prior manufacturing techniques provide pressure relief devices that are highly effective, such techniques also have relatively significant quality control requirements to provide reproducible results.

An additional variable which must be accounted for in the formation of a controlled pressure vent is that the sheet metal from which the device is formed may vary slightly in starting thickness. If the starting material in the region being coined is thinner than specified, then displacement of a defined amount of material during the coining process will produce an underlying web at the coined region which will be thinner than expected. This may result in a slightly lower rupture strength than anticipated. Likewise, if the starting material in the region being coined is thicker than specified, then displacement of a defined amount of material during the coining process will produce an underlying web at the coined region which will be thicker than expected thereby producing a slightly higher rupture strength than anticipated. Accordingly, the thickness of the metal is monitored closely to ensure reproducible venting characteristics.

In the event that venting does not take place at the prescribed elevated pressure level as intended, the pressure inside the container may increase until there is an eventual failure at the bottom. This failure typically results in the bottom of the container bulging out substantially at the center such that the concave dome of the bottom reverses upon itself and eventually fails by bursting to permit the escape of the pressurized contents.

In the past, it has been difficult to achieve ultimate strength levels in the container bottom that allow the container bottom to withstand pressures significantly above the intended venting pressure in the event that venting does not take place. Thus, there has been a relatively narrow difference between the designed venting pressure and the pressure level causing bottom reversal. It may be desirable for the pressure level causing bottom reversal to be significantly higher than the intended venting pressure to account for variability in coining tools and/or material thickness. At the same time, the intended venting pressure should be high enough to accommodate normal pressure variations without premature venting.

Consequently, there is a continuing need for a pressure relief device having a coined pressure vent that can be mass produced in a manner that will provide reproducible venting at desired pressures with a reduced potential for variability arising from inherent differences in coin depth and/or material thickness during the manufacturing process. There is also a need for a pressure relief device having a coined pressure vent that can be mass produced and which provides ultimate strength levels in the container bottom that allow the container bottom to withstand significant pressures before reversal bursting failure in the event that venting does not take place.

SUMMARY OF THE INVENTION

The present invention provides advantages and alternatives over the prior art by providing a pressure relief device for venting an internally pressurized container and an aerosol can having a can bottom containing this pressure relief device. The pressure relief device includes a coined pressure vent and is characterized by a relatively high venting pressure of about 380 psig or greater in combination with a failure pressure in the absence of venting which is at least about 50 psig higher than the intended venting pressure.

In accordance with one exemplary aspect, the present invention provides a pressure relief device of domed construction adapted to vent contents of an internally pressurized container upon development of a pre-defined pressure within the container. The pressure relief device includes a sloped sidewall having an outer annular segment and a sloped annular intermediate segment. The sloped annular intermediate segment has a width dimension greater than the width dimension of the outer annular segment. A circular central plateau intersects the sloped sidewall to define a flat dome top of the pressure relief device. The circular central plateau has a center point disposed at the radial center of the pressure relief device and an arc shaped coin line extending about an arc with the apex of the arc positioned at the center point of the circular central plateau. The pressure relief device is characterized by a venting pressure of not less than 380 psig and a dome reversal pressure of at least 50 psig greater than the venting pressure.

According to another exemplary aspect, the present invention provides an aerosol can having a top adapted to expel contents in a controlled manner, a can bottom and a sidewall extending between the top and the bottom. The can bottom defines a pressure relief device of domed construction adapted to vent contents of the can upon development of a pre-defined pressure within the can. The pressure relief device includes a sloped sidewall having an outer annular segment and a sloped annular intermediate segment. The sloped annular intermediate segment has a width dimension greater than the width dimension of the outer annular segment. A circular central plateau intersects the sloped sidewall to define a flat dome top of the pressure relief device. The circular central plateau has a center point disposed at the radial center of the pressure relief device and an arc shaped coin line extending about an arc with the apex of the arc positioned at the center point of the circular central plateau. The arc shaped coin line has a depth providing a remaining web of material with a thickness of not more than 0.007 inches. The pressure relief device is characterized by a venting pressure of not less than 380 psig and a dome reversal pressure of at least 50 psig greater than the venting pressure.

Other objects and advantages of the pressure relief device and aerosol can will become apparent from a description of certain preferred embodiments thereof which are shown in the drawings.

BRIEF DESCRIPTION OF THE DRAWINGS

FIG. 1 is a bottom perspective view of an exemplary aerosol container including a pressure release device consistent the present invention;

FIG. 2 is a plan view of a first embodiment for the bottom of a container including a pressure release device consistent with the present invention;

FIG. 3 is a sectional view through taken along line 3-3 in FIG. 2 with the vent closed;

FIG. 4 is a view similar to FIG. 3 showing container sidewalls and with the vent released;

FIG. 5 is a plan view illustrating an exemplary arc-shaped coined vent for use in a pressure release device consistent the present invention; and FIG. 6 is a sectional view taken along line 6-6 in FIG. 2.

Figure 7:
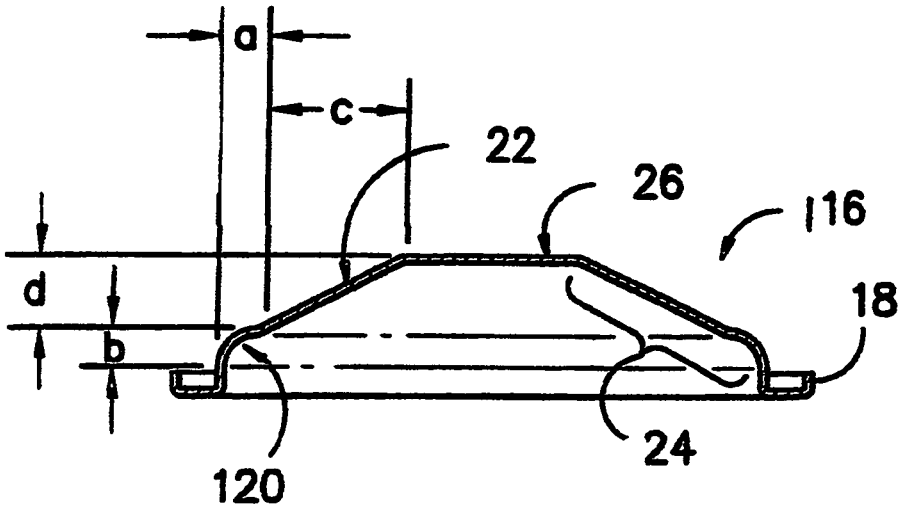
FIG. 7 is a schematic view similar to FIG. 3 illustrating another embodiment of a pressure relief device consistent with the present disclosure.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF PREFERRED EMBODIMENTS

Referring now to the drawings, a container 10 such as an aerosol can of the type conventionally employed to package and dispense pressurized fluid products is shown in FIG. 1. The container has a cylindrical side wall 12 with a reduced diameter neck 14 at one end to accommodate acceptance of a conventional cap, dispensing valve or the like (not shown). The opposite end or bottom of the container is closed by a pressure relief device 16 adapted to vent contents of the container in the event that pressure increases beyond predefined levels. The pressure relief device 16 can be used on any type of pressurized can known in the art. By way of example only, and not limitation these cans typically will have a diameter between about 1.375 inches and about 8.25 inches.

A first embodiment of the pressure relief device 16 is shown in FIGS. 2 through 4. The pressure relief device 16 is preferably of unitary construction formed from a single piece of steel or other deformable metal. By way of example only, the pressure relief device 16 may be formed by manufacturing techniques such as are described in U.S. Pat. No. 7,222,757 which is incorporated by reference herein. One exemplary material for use in forming the pressure relief device 16 is electrolytic tin coated, single reduced sheet steel with a thickness of about 0.024 inches. In some environments of use, such steel material with a thickness of at least 0.024 inches may be desired to provide failure pressures in excess of 500 psig. However, other materials with thicker or thinner cross sectional dimensions may likewise be used if desired. As illustrated, the pressure relief device 16 includes an annular lip 18 adapted to be connected to the container side wall 12 by any conventional means, such as for example a double seam connection commonly used in the art (FIG. 4).

As best seen through joint reference to FIGS. 2 and 3, the pressure relief device 16 has a relatively narrow outer annular segment 20 located in adjacent inboard relation to the annular lip 18. As illustrated in FIGS. 3 and 4, the outer annular segment 20 may be slightly curved along its width (i.e. height) dimension to define an indentation along the exposed surface of the pressure relief device 16 adjacent to the annular lip.

In the illustrated exemplary embodiment, the outer annular segment 20 is integrally connected to a sloped annular intermediate segment 22. As indicated previously, the annular intermediate segment 22 is angled but is not bowed substantially in the width dimension extending away from the outer annular segment 20. Thus, in the embodiment of FIGS. 2-4, the sides of the pressure relief device 16 transition from the curve of the outer annular segment 20 to the substantially continuous slope of the sloped annular intermediate segment 22. It is also contemplated that the outer annular segment 20 may have substantially no curvature or very little curvature in the width dimension if desired.

In the illustrated exemplary embodiment the outer annular segment 20 is steeper but shorter than the sloped annular intermediate segment 22. Thus, a tangent line to the midpoint of the outer annular segment 20 is steeper than the sloped annular intermediate segment 22. By way of example only, as illustrated in FIG. 3, in one exemplary embodiment used in an aerosol can with an inner diameter of about 2.86 inches, the outer annular segment 20 may have a width "a" of about 0.298 inches with an elevation change "b" of about 0.235 inches and the annular intermediate segment 22 may have a width "c" of about 0.69 inches with an elevation change "d" of about 0.375 inches. In another exemplary embodiment used in an aerosol can with an inner diameter of about 2.58 inches, the outer annular segment may have a width "a" of about 0.298 inches with an elevation change "b" of about 0.195 inches and the annular intermediate segment may have a width "c" of about 0.55 inches with an elevation change "d" of about 0.33 inches. It is contemplated that the ratio of the width "c" to the width "a" will preferably be in the range of about 1.5 to about 3. However, higher and lower ratios also may be used. The outer annular segment 20 and the annular intermediate segment 22 cooperatively form a sloped sidewall 24 (FIG. 4).

As illustrated, in the exemplary embodiment, the sloped sidewall 24 intersects with a circular central plateau 26 defining the top of the pressure relief device 16. In the exemplary embodiment, the circular central plateau 26 is substantially flat and has an arc shaped coined line 28 (also referred to as a "coin"). The circular central plateau 26 preferably has a thickness substantially equivalent to the outer annular segment 20 and the sloped annular intermediate segment 22. As best seen through joint reference to FIGS. 2 and 5, the arc shaped coined line 28 is positioned with its apex 30 (shown by the intersection of the crossing lines at the arc centerline in FIG. 5) substantially centered relative to the circular central plateau 26. Thus, the circular central plateau 26 is concentric relative to the overall circumference of the pressure relief device 16 and the apex 30 is centered relative to the circular central plateau 26. Accordingly, the central axis of symmetry of the pressure relief device 16 preferably intersects and passes through the arc shaped coined line 28 at its apex.

Referring now to FIGS. 5 and 6, in the exemplary embodiment the coin profile is preferably defined by an arc angle "e" in the range of about 95 degrees to about 105 degrees and more preferably about 98 degrees to about 102 degrees and most preferably about 100 degrees. However, other arc profiles may be used if desired. The coined line 28 is preferably formed to provide a remaining web thickness opposing the coined line of not more than about 0.007 inches and more preferably less than about 0.005 inches. In one exemplary embodiment in which the pressure relief device is formed from a unitary piece of electrolytic tin coated, sheet steel with a thickness of about 0.024 inches, the coined line 28 may have a depth "f" of about 0.0195 inches (FIG. 6) thereby resulting in a remaining opposing web thickness of about 0.0045 inches. Of course, other depth dimensions may be used if desired.

As best seen in FIG. 6, the coined line 28 may have a substantially trapezoidal cross section profile. In one exemplary embodiment in which the pressure relief device 16 is formed from a unitary piece of electrolytic tin coated, sheet steel with a thickness of about 0.024 inches, the coined line 28 may have a width of about 0.033 inches at the exterior and about 0.010 to 0.012 inches at the interior, although other width dimensions may be used if desired. According to one potentially preferred embodiment, the angled side walls in the coined line 28 may cooperatively form an angle "g" of about 60 degrees with each side wall having about a 30 degree taper.

As noted previously, the configuration and orientation of the arc-shaped coined line 28 with the apex 30 of the arc substantially at the center of both the pressure relief device 16 and the circular central plateau 26 promotes significant functionality. Specifically, the configuration and placement of the coined line 28 with the tangent point of the arc centerline substantially centered about the overall bottom circumference aids significantly in promoting venting prior to bursting since the centerline apex of the arc corresponds substantially with the central location on the dome where bulging tends to start prior to bursting failure. Thus, as bulging takes place, the coined line will begin to tear to release pressure. As this tearing takes place, a vent opening is established as a flap 34 at the interior of the coined line 28 is pushed downwardly away from the surrounding portion of the circular central plateau.

As noted previously, the outer annular segment 20 may be slightly concave across its inner surface, thereby defining a curvature in the height dimension. The annular intermediate area 22 is substantially planar in the height dimension between the outer annular segment 20 and the circular central plateau 24. Thus, in some embodiments the dome transitions from a curved surface (the outer annular segment 20) to a planar surface (the sloped annular intermediate segment 22). This transition is preferably substantially smooth without the occurrence of a step at the intersection. Moreover, the slope of a tangent to the midpoint of the outer annular segment 20 is steeper than the slope of the annular intermediate segment 22. Thus, the pitch of the dome transitions from a steep slope along the outer annular segment 20 to a more shallow slope along the sloped annular intermediate segment.

The dome height and dimensions of the circular central plateau 26 may be correlated with overall can diameter to provide high reversal pressures while maintaining a minimum 50 psig differential between venting and plain bottom burst equivalent. Nonetheless, by virtue of the overall configuration, venting does not commence until significant pressure is developed. Thus, premature venting may be avoided. In utilizing the illustrated and described construction it has been found that during normal operation when the container is over pressurized at about 400 psig, the bottom will open along the coined line 28 thereby allowing the can to vent. In the event that venting fails to take place, the bottom will fail by reversal at a pressure level of at least 50 psig above the intended venting pressure and more preferably about 100 psig or greater above the intended venting pressure. Thus, the can bottom may be designed to withstand about 500 psig or greater without bursting even if venting does not take place. The substantial differential between designed venting pressure and the failure pressure corresponding to dome reversal in the absence of venting reduces the influence of any variation in the manufacturing process that may cause the actual venting pressure to deviate from the intended level. Thus, even a very substantial inconsistency in the actual venting pressure will not result in bursting failure. By way of example only, if the actual realized venting initiation pressure is as much as 25% higher than an intended level of 400 psig, a bursting failure will nonetheless be avoided.

The design relationships are robust across a wide range of standard can diameters. According to an exemplary design procedure, a plain bottom equivalent (i.e. with no coining) is fabricated for a given diameter to achieve a burst pressure in excess of about 500 psig. Next, the annular profiles and dome height are established holding the arc of the outer annual profiles constant. The diameter for the flat circular central plateau is then established. Thus, a standard set of geometries can be established based on diameter requirements, and plain bottom reversal. Burst strength may be confirmed by iterative testing in which a container is pressurized without the presence of a coined line. Upon confirming that burst strength in the absence of venting exceeds about 500 psig or greater, an arc-shaped coined line as previously described is introduced with the centerline apex of the arc substantially at the center of the flat circular central plateau. The depth of the coined line is desirably set such that venting will normally take place at a pressure level of at least 380 psig or higher (preferably about 400 psig). This depth may be calculated or determined by iterative testing.

As will be appreciated, a pressure relief device 16 which is designed and formed according to the above procedure will be prone to venting pressure release well in advance of any bursting failure. Moreover, even if variations in manufacturing cause the actual venting pressure to be much higher than expected, venting will nonetheless take place prior to bursting failure due to the high burst strength levels.

FIG. 7 illustrates another embodiment of a pressure relief device consistent with the present disclosure wherein elements corresponding to those previously described are designated by like reference numerals increased by 100. As shown, in this embodiment, the outer annular segment 120 is slightly concave across its inner surface in the width dimension of the pressure relief device 116.

Of course, variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments and equivalents to the extent permitted by the prior art.

Various features of the invention are set forth in the following claims.

What is claimed is:

1. A pressure relief device of domed construction adapted to vent contents of an internally pressurized container upon development of a pre-defined pressure within the container, the pressure relief device having a center and comprising:

a sloped sidewall including an outer annular segment and a sloped annular intermediate segment, the sloped annular intermediate segment having a width dimension greater than a width dimension of the outer annular segment; and a circular central plateau intersecting the sloped sidewall to define a concentric flat dome top of the pressure relief device, the circular central plateau having a center point disposed at the center of the pressure relief device and an arc shaped coin line extending about an arc, the arc having an apex with the apex of the arc positioned at the center point of the circular central plateau and wherein the arc shaped coin line has a depth providing a remaining opposing web of material with a thickness of not more than 0.007 inches, wherein the circular central plateau is formed from a piece of metal having a defined thickness, and wherein the thickness of the remaining opposing web of material is equal to the defined thickness of the piece of metal minus the depth of the arc shaped coin line, and wherein the pressure relief device is characterized by a venting pressure of not less than 380 psig and a dome reversal pressure of at least 50 psig greater than the venting pressure, wherein the arc shaped coin line is trapezoidal in transverse cross section, wherein the sloped annular intermediate segment has the width dimension at least 1.5 times greater than the width dimension of the outer annular segment and wherein the outer annular segment is concave in the width dimension.

2. The pressure relief device as recited in claim 1, wherein the pressure relief device is of unitary metal construction formed from a single piece of sheet steel.

3. The pressure relief device as recited in claim 2, wherein the outer annular segment, the sloped annular intermediate segment and the circular central plateau each have a common thickness.

4. The pressure relief device as recited in claim 3, wherein the common thickness is about 0.024 inches or greater.

5. The pressure relief device as recited in claim 1, wherein the sloped annular intermediate segment has the width dimension at least 1.5 times greater than the width dimension of the outer annular segment.

6. The pressure relief device as recited in claim 5, wherein the outer annular segment is steeper than the sloped annular intermediate segment.

7. The pressure relief device as recited in claim 1, wherein the arc shaped coin line extends through an angle of about 95 degrees to 105 degrees.

8. The pressure relief device as recited in claim 1, wherein the arc shaped coin line extends through an angle of about 98 degrees to 102 degrees.

9. The pressure relief device as recited in claim 1, wherein the arc shaped coin line is trapezoidal in transverse cross section with the depth of the arc shaped coin line providing the remaining opposing web of material with the thickness of not more than about 0.005 inches and wherein the arc shaped coin line extends through an angle of about 100 degrees.

10. A pressure relief device of domed construction adapted to vent contents of an internally pressurized container upon development of a pre-defined pressure within the container, the pressure relief device having a center and comprising:

a sloped sidewall including an outer annular segment having a predefined thickness and a sloped annular intermediate segment of the same predefined thickness, the sloped annular intermediate segment having a width dimension at least 1.5 times greater than a width dimension of the outer annular segment, and wherein the outer annular segment is shorter and steeper than the annular intermediate segment; and a circular central plateau intersecting the sloped sidewall to define a concentric flat dome top of the pressure relief device, the circular central plateau having a center point disposed at the center of the pressure relief device and an arc shaped coin line extending through an angle of 95 degrees to 105 degrees about an arc, the arc having an apex with the apex of the arc positioned at the center point of the circular central plateau and wherein the arc shaped coin line is trapezoidal in transverse cross section with a depth providing a remaining opposing web of material with a thickness of less than about 0.005 inches, wherein the circular central plateau is formed from a piece of metal having a defined thickness, and wherein the thickness of the remaining opposing web of material is equal to the defined thickness of the piece of metal minus the depth of the arc shaped coin line, wherein the pressure relief device is characterized by a venting pressure of not less than 380 psig and a dome reversal pressure of at least 50 psig greater than the venting pressure, wherein the sloped annular intermediate segment has the width dimension at least 1.5 times greater than the width dimension of the outer annular segment and wherein the outer annular segment is concave in the width dimension.

11. The pressure relief device as recited in claim 10, wherein the pressure relief device is of unitary metal construction formed from a single piece of sheet steel.

12. The pressure relief device as recited in claim 11, wherein the outer annular segment, the sloped annular intermediate segment and the circular central plateau each have a common thickness.

13. The pressure relief device as recited in claim 12, wherein the common thickness is about 0.024 inches or greater.

14. The pressure relief device as recited in claim 10, wherein the arc shaped coin line extends through the angle of 98 degrees to 102 degrees.

15. The pressure relief device as recited in claim 10, wherein the arc shaped coin line extends through the angle of about 100 degrees.

16. An aerosol can having a top adapted to expel contents in a controlled manner, a can bottom and a sidewall extending between the top and the bottom, the can bottom defining a pressure relief device of domed construction adapted to vent contents of the can upon development of a pre-defined pressure within the can, the pressure relief device having a center and comprising:

a sloped sidewall including an outer annular segment having a first width dimension and a sloped annular intermediate segment having a second width dimension, wherein the second width dimension is in a range of about 1.5 to 3 times greater than the first width dimension; and a circular central plateau intersecting the sloped sidewall to define a concentric flat dome top of the pressure relief device, the circular central plateau having a center point disposed at the center of the pressure relief device and an arc shaped coin line extending about an arc, the arc having an apex with the apex of the arc positioned at the center point of the circular central plateau and wherein the arc shaped coin line has a depth providing a remaining opposing web of material with a thickness of less than about 0.005 inches, wherein the circular central plateau is formed from a piece of metal having a defined thickness, and wherein the thickness of the remaining opposing web of material is equal to the defined thickness of the piece of metal minus the depth of the arc shaped coin line, wherein the pressure relief device is characterized by a venting pressure of not less than 380 psig and a dome reversal pressure of at least 50 psig greater than the venting pressure, wherein the arc shaped coin line is trapezoidal in transverse cross section, and wherein the outer annular segment is concave in the width dimension.

17. The aerosol can as recited in claim 16, wherein the outer annular segment is steeper than the sloped annular intermediate segment and wherein the arc shaped coin line and extends through an angle of about 98 degrees to 102 degrees.

* * * * *